US005658168A

United States Patent [19]

Myer et al.

[11] Patent Number: 5,658,168

[45] Date of Patent: Aug. 19, 1997

[54] SINGLE PIECE PIN CONTACT

[75] Inventors: John M. Myer, Millersville, Pa.; Edward L. Pentz, Greensboro, N.C.

[73] Assignee: The Whitaker Corporation, Wilmington, Del.

[21] Appl. No.: 402,579

[22] Filed: Mar. 13, 1995

[51] Int. Cl.[6] ..... H01R 13/42

[52] U.S. Cl. ..... 439/595; 439/744

[58] Field of Search ..... 439/595, 744, 439/745, 746

[56] References Cited

U.S. PATENT DOCUMENTS

| | | | |
|---|---|---|---|
| 3,852,704 | 12/1974 | Muz | 439/825 |
| 3,957,337 | 5/1976 | Damiano | 439/748 |
| 4,640,567 | 2/1987 | Lundergan et al. | 339/94 M |
| 4,944,688 | 7/1990 | Lundergan | 439/275 |
| 4,955,827 | 9/1990 | Roy et al. | 439/744 |
| 4,979,912 | 12/1990 | Shindo et al. | 439/595 |
| 4,998,896 | 3/1991 | Lundergan | 439/595 |
| 5,067,916 | 11/1991 | Denlinger et al. | 439/857 |
| 5,487,686 | 1/1996 | Sawara | 439/884 |

*Primary Examiner*—Neil Abrams
*Assistant Examiner*—T. C. Patel

[57] ABSTRACT

An electrical pin contact (10) having a wire insulation gripping section (11), a wire conductor gripping section (12), a transition section (14), a shank section (16), a retention section (20), and a pin contact section (30). The retention section (20) includes a shoulder (26) with latching projections (26*a*) formed thereon for engagement with a latching arm of a connector housing when the pin contact (10) has been inserted therein. Latching projections (26*a*) are formed by seams in the shoulder (26). Projections (26*a*) will increase the frictional retention of contact (10) in an electrical connector housing.

31 Claims, 3 Drawing Sheets

SINGLE PIECE PIN CONTACT

The present invention relates to a stamped and formed electrical pin contact for use with an electrical connector. More specifically, the present invention relates to a single-piece electrical pin contact having a plurality of projections located on a bottleneck portion thereof for increased retention of the pin contact in an electrical connector housing.

BACKGROUND OF THE INVENTION

Stamped and formed electrical contacts are disclosed in references U.S. Pat. Nos. 4,998,896 and 4,944,688. The electrical contacts therein disclosed are stamped and formed contacts adapted for disposition in an electrical connector housing which housing includes resilient latching arms adapted to deflect outwardly when the contacts are inserted into the housing. When a contact is in a fully inserted position, the latching arms will resile towards the electrical contact and frictionally engage a shoulder thereof. The electrical contacts of the foregoing references require a radiused shoulder thereon which engages the latching arm. The known inventions provide an advantageous way of connecting an electrical contact to an electrical connector housing; however, the radiused shoulder on the contact can result in a contact's removal from the electrical connector housing as the latching arm will have reduced frictional contact therewith and will therefore slide around the radiused shoulder in response to a pulling force applied to its respective wire. Thus, such a radiused shoulder can result in a decrease of the contact's retention performance.

Another known electrical contact is disclosed in U.S. Pat. No. 4,640,567. The electrical contact disclosed therein includes a terminal having deflectable lances which project relatively outwardly from the body of the electrical contact. As the electrical contact is inserted into an electrical connector housing, the deflectable lances will deflect inwardly in response to engagement with a camming shoulder, and then will deflect outwardly and engage a locking shoulder thereby retaining the contact in the housing. This known electrical contact advantageously latches an electrical terminal to a housing; however, the contact requires the additional step of forming the deflectable lances by lancing the walls of the contact outwardly during the contact-forming process.

The present invention seeks to overcome the deficiencies of prior connectors by providing an electrical contact which is stamped and formed, but does not necessarily require the extra step of forming lances on the contact body. Moreover, the present invention does not rely on a radiused shoulder alone for retention of the contact in the housing, but includes sharp projections formed on the contact during the forming process which will frictionally engage a latching arm of the electrical connector housing when the electrical contact is in an inserted position relative to the housing.

SUMMARY OF THE INVENTION

The present invention provides an electrical connector assembly including an electrical connector housing and an electrical contact, the assembly comprising a housing which includes a latching arm formed therein for latching engagement with the electrical contact. The electrical contact includes a retention section for frictional engagement with the latching arm, and the retention section includes a plurality of latching projections formed on the retention section during a stamping and forming process of the electrical contact. Additionally, the latching projections are spaced along a shoulder of the retention section so that a portion of the latching arm will engage at least one of the latching projections regardless of the rotational orientation of the contact with respect to the housing.

DETAILED DESCRIPTION OF THE INVENTION

Figure 1:
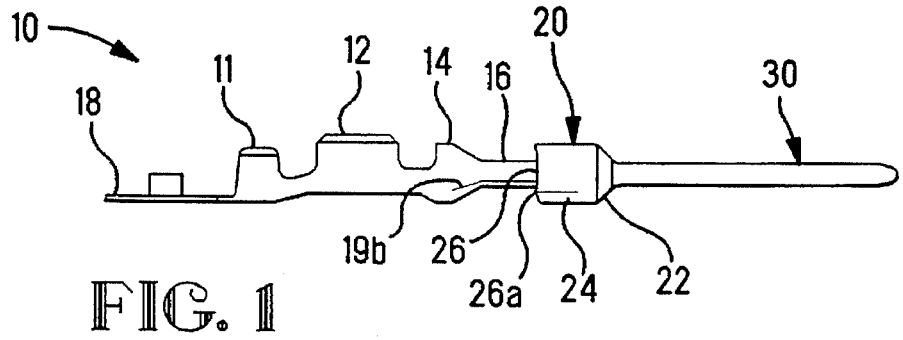
FIG. 1 shows a side elevational view of the electrical contact according to the present invention.

Referring to FIG. 1, the electrical contact 10 according to the present invention will now be described. Contact 10 includes a wire insulation gripping section 11, a wire conductor gripping section 12, a transition section 14, a shank or bottleneck section 16, a retention section 20, a lateral seam **19*b*, and a pin contact section 30. Pin contact 10 is shown connected to carrier strip 18 adjacent to wire insulation gripping section 11, but will, of course, be severed therefrom after the stamping and forming process. Retention section 20 includes a frusto-conical section 22, an annular section 24, and a generally radially directed shoulder 26 having relatively sharp latching projections 26*a*** formed thereon.

Figure 2:
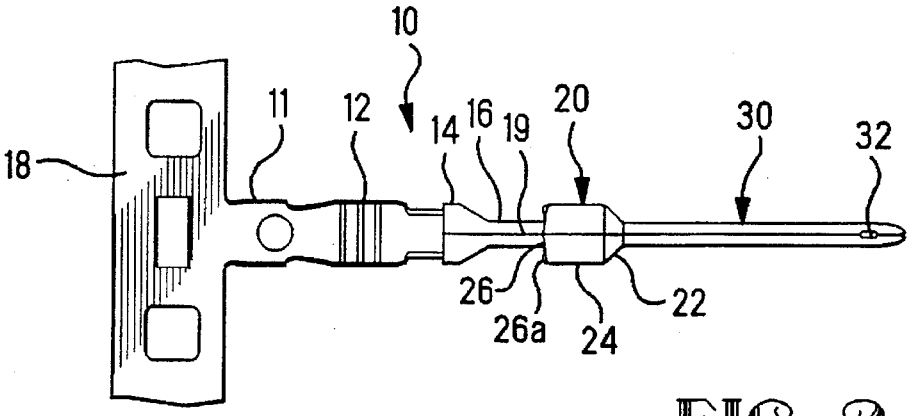
FIG. 2 shows a top view of the electrical contact of FIG. 1.

FIG. 2 shows a top view of the electrical contact of FIG. 1. Top seam 19 is formed along the longitudinal axis of contact 10, and contact 10 includes two seams **19*b* disposed relatively laterally of seam 19 at preferably 120 degree spaced-apart intervals (see FIG. 8). Pin contact section 30 includes bleed hole 32 for allowing the removal of plating salt residue. As best shown in FIG. 2, ridges are provided in the wire gripping section 12** for gripping conductors of a wire (not shown in the drawing).

Figure 3:
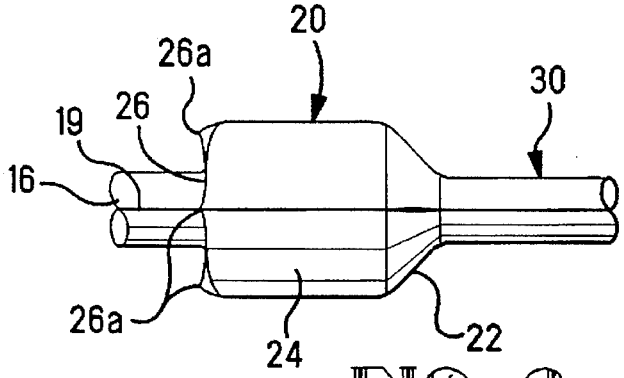
FIG. 3 shows an enlarged view of the retention section or bottleneck area of the electrical contact of FIG. 1.

FIG. 3 shows an enlarged view of the retention section 20. Three sharp latching projections **26*a* are formed on shoulder 26 of section 20. Seam 19 is shown in this top view as being generally aligned with an apex of a respective latching projection 26*a*; in a like manner, seams 19*b* are generally aligned with a respective latching projection 26*a* (see FIG. 8). Frusto-conical section 22 is adapted to engage and deflect an electrical housing latching arm during insertion of the contact 10**, as further described below.

Figure 4:
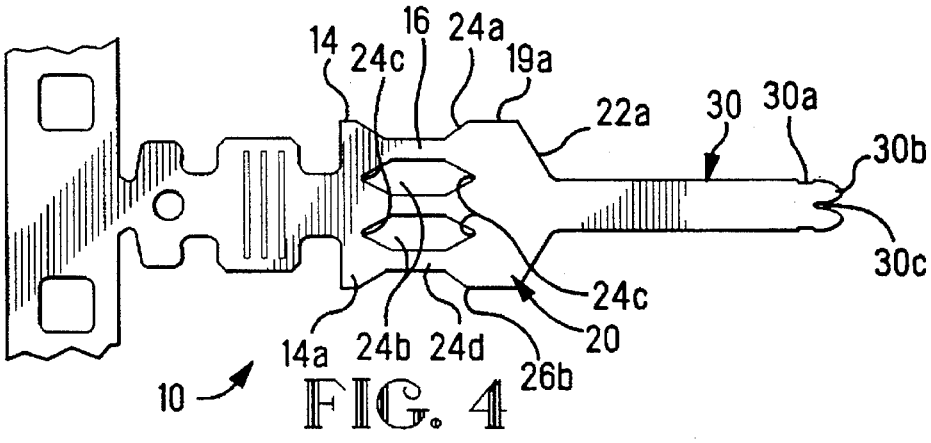
FIG. 4 shows the electrical contact of FIG. 1 prior to being formed, i.e. in the form of a blank.

FIG. 4 shows the electrical contact of FIG. 1 in blank form. The blank includes tapers **14*a* of transition section 14, seam edges 19*a* of top seam 19, tapers 22*a* of frusto-conical section 22, tapers 24***a*, punch outs 24*b* having corresponding V-shaped edges 24*c*, and straps 24*d*. Shoulder edge 26*b* is a portion of shoulder 26 shown in blank form. Pin contact section 30 includes recesses 30*a*, tips 30*b*, and a divot 30*c* therebetween.

During the forming processes, pin contact 10 will be preferably subjected to, for example: a curling process; a U-ing process; and then a sizing process will roll the contact into its final shape as shown in FIG. 1. During these processes, punch outs 24*b* will be laterally collapsed into forming respective seams 19*b* on shank portion 16. In like manner, V-shaped edges 24*c* of punch outs 24*b* will collapse and thereby comprise a portion of a respective seam 19*b* on shoulder 26, with the opposing V-shaped edges 24*c* of punch outs 24*b* being collapsed to form a portion of a respective seam 19*b* on transition section 14 (see FIG. 8). Thus, seams 19*b* will be located on a portion of shoulder 26, shank 16, and transition section 14. Additionally, the forming process will move straps 24*d* closer together and then into engagement with each other as punch outs 24*b* are collapsed.

Continuing the description of the forming process, tapers 22*a* will be formed into frusto-conical shape 22 as shown in FIG. 3. Shoulder edge 26*b* will be rounded into the shape shown in FIGS. 1 and 2 at shoulder 26. Tapers 24*a* will be folded to form a portion of shoulder 26 and top seam 19, and axially opposing tapers 14*a* will be folded to form a portion of transition section 14 and top seam 19. Recesses 30*a* and tips 30*b* will be bent into engagement with each other about divot 30*c*, thereby forming bleed hole 32.

As noted above, tapers 14*a* and 24*a*, punch outs 24*b*, V-shaped edges 24*c*, and straps 24*d* are used in creating seams 19,19*b* during the forming process. However, seams 19,19*b* will comprise localized stress concentrations in corners and bends adjacent thereto, and geometric discontinuities will exist at gaps and seams in the contact's material. Stress concentrations will be in the general areas around V-shaped edges 24*c* and tapers 24*a* after the retention section 20 has been formed. This advantageously results in the formation of sharp latching projections 26*a* thereat, and thus demonstrates the advantage of seams 19,19*b* being generally in coincidence with the latching projections 26*a*. The latching projections 26*a*, because they comprise relatively sharp projections, are capable of a high degree of frictional engagement with a latching arm of an electrical connector housing, as will be further described below. The outer radial sections of shoulder 26, between projections 26*a*, will have a relatively less sharp or radiused contour.

Figure 5:
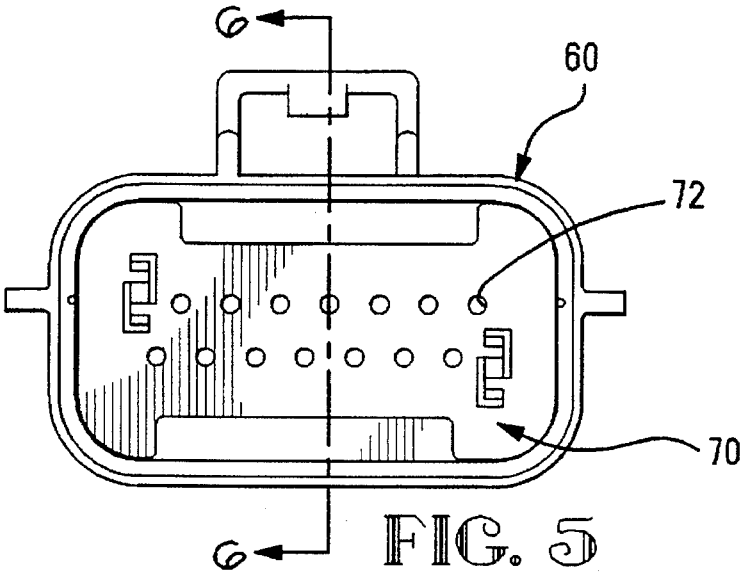
FIG. 5 shows a front elevational view of an electrical connector housing for use with the present invention.

FIG. 5 shows an electrical connector housing 60 with double lock member 70 for use with the present invention. Double lock member 70 includes apertures 72 for receiving contact section 30 of contact 10 therethrough.

Figure 6:
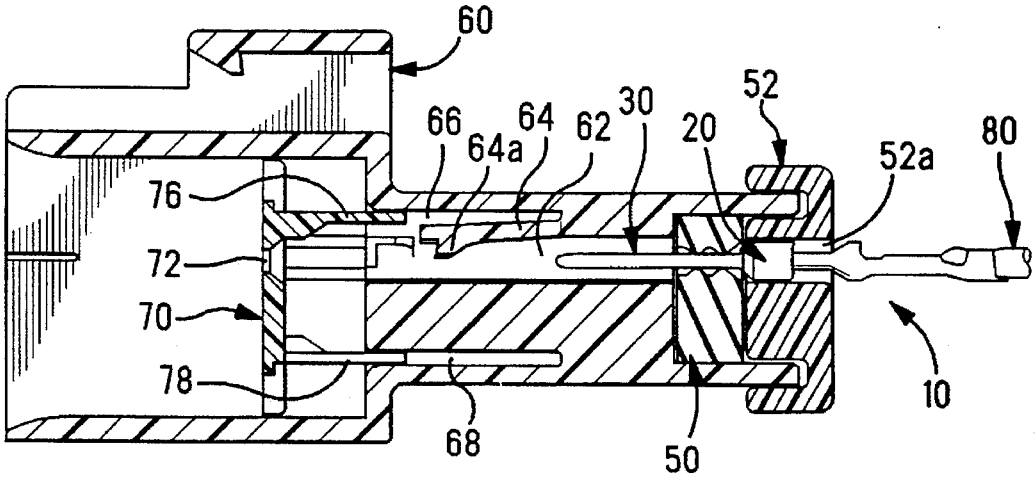
FIG. 6 shows a side view of the electrical contact of FIG. 7 being inserted into a cross sectional view of electrical connector housing of FIG. 5.

FIG. 6 shows a cross section of the connector housing 60 of FIG. 5 and includes a cap 52 with apertures 52*a* therein, sealing grommet 50, and a wire 80 connected to contact 10. Connector housing 60 includes contact receiving apertures 62, deflectable latching arm 64 with latching pawl 64*a* formed thereon, a double lock recess 66, and a guide recess 68. Double lock member 70 includes a double lock peg 76 and a guide peg 78.

Figure 7:
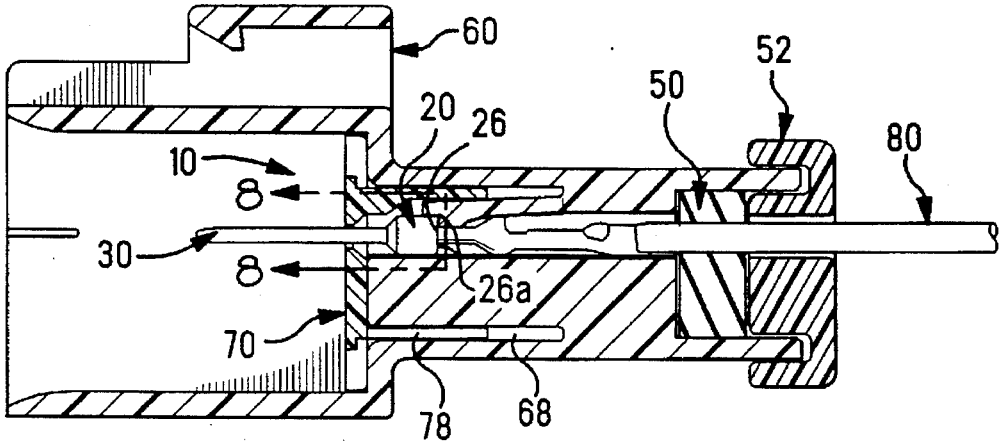
FIG. 7 shows the electrical contact of FIG. 1 when it is in a fully-inserted position in the electrical connector housing of FIG. 6.

FIG. 7 shows electrical contact 10 in the fully inserted position within contact housing 60. Contact 10 is shown fully advanced beyond grommet 50, and pin contact section 30 is disposed through aperture 72 of double lock member 70. As contact 10 is inserted into housing 60, deflectable latching arm 64 will be deflected into recess 66 by sliding engagement with frusto-conical section 22 of contact 10. Next, latching pawl 64*a* will resile downwardly into frictional engagement with latching projections 26*a* of shoulder 26. When contact 10 is in the fully latched position, double lock member 70 is then advanced into housing 60 so that double lock peg 76 will be snugly disposed in double lock recess 66, thereby locking latching arm 64 in place. Additionally, guide peg 78 will be inserted into guide recess 68 thereby assuring proper alignment of double lock member 70 with respect to connector housing 60 and contact 10. Sealing grommet 50 will engage and seal around the insulation of wire 80. Thus a preferred use of the contact 10 provides a sealed, double locked connector with high frictional retention of the contact 10 within the housing 60.

Figure 8:
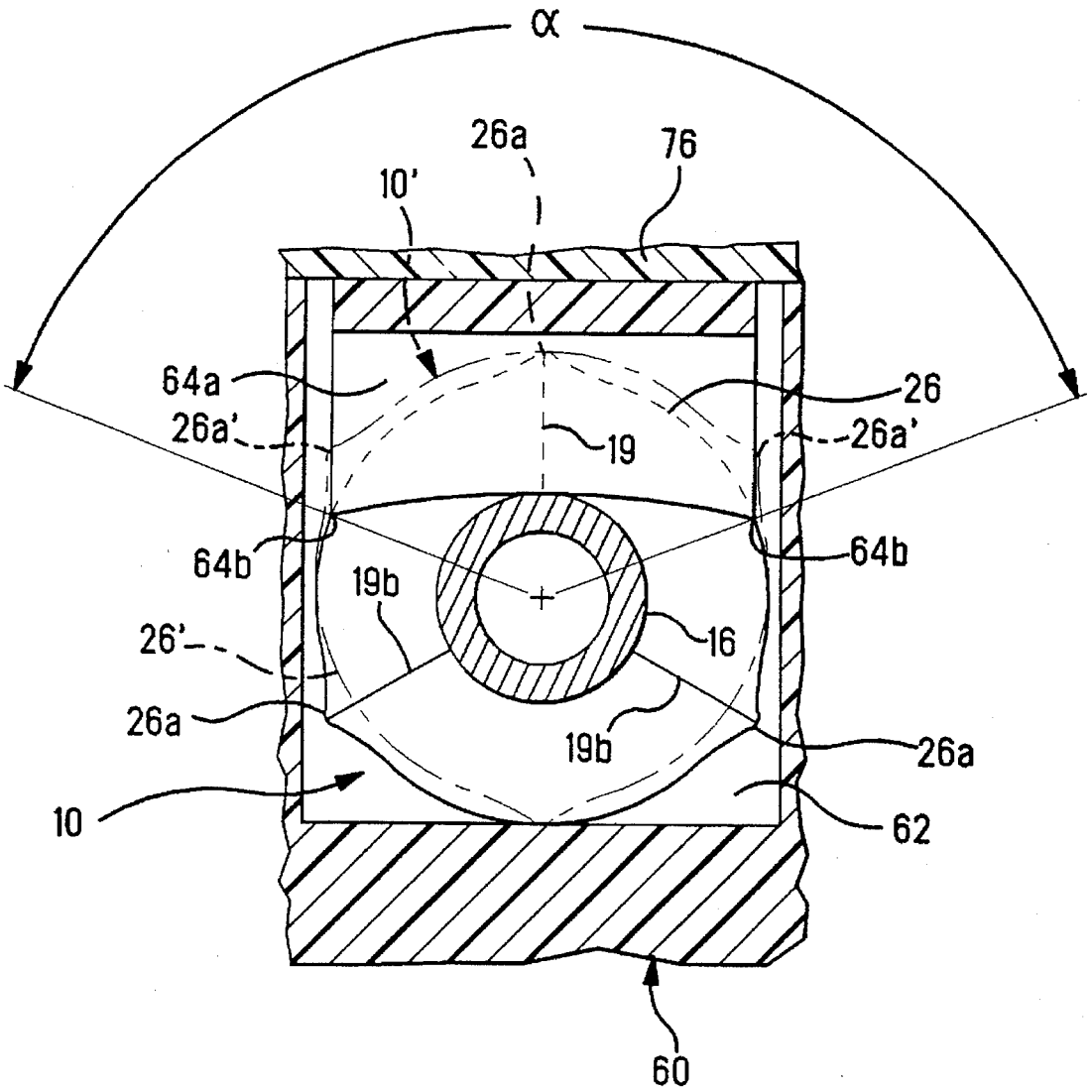
FIG. 8 shows a cross sectional view of the electrical contact of the present invention as shown in FIG. 7 along line 8—8, and which depicts the housing latching arm engaging a projection formed on the electrical contact of FIG. 1.

FIG. 8 shows a partial cross section of FIG. 7 wherein the contact 10 has been fully inserted into electrical connector housing 60. Angle $\alpha$ shows, for example, an angle generally centered on the axial center of shank section 16 and is greater than 120 degrees as defined between the edges 64*b* of latching pawl 64*a*. This is advantageous because the latching pawl will always engage a latching projection 26*a* of shoulder 26 when the seams 19,19*b* are spaced at a suitable angle less than $\alpha$, for example, 120 degrees apart. In this way, at least one latching projection 26*a* will be poised for frictional engagement with latching pawl 26*a* irrespective of the angular orientation of contact 10 with respect to housing 60 and latching pawl 64*a*. As an example of this orientation feature, FIG. 8 shows a contact 10' in phantom lines having an angular orientation different from that of contact 10, such that two latching projections 26*a'* are shown poised to engage latching pawl 64*a*.

Thus, while a preferred embodiment of the invention has been disclosed, it is to be understood that the invention is not to be strictly limited to such embodiment. For example, more or less than three seams can be formed in the electrical contact to thereby produce a corresponding number of projections 26*a* on the contact, e.g. four seams can be formed at 90 degree intervals with four latching projections. Moreover, although a pin contact section 30 is shown, it is contemplated that a receptacle contact portion can be formed on retention section 20 instead; for example, such receptacle contact sections as are disclosed in references U.S. Pat. Nos. 4,998,896 and 4,944,688, which are hereby incorporated by reference in their entirety. Furthermore, contact 10 is preferably made of a base material selected from the group comprising: copper, brass, bronze, beryllium copper, copper alloys, steel, nickel, aluminum, and zinc. Additionally, it is preferred that metal contact 10 will be plated with a corrosive-resistant finish, for example: tin, tin low lead, tin-lead, nickel, gold, silver, copper, zinc, or palladium. The plating material can be electroplated by an electrodeposition process known to those of ordinary skill in the electro-plating art.

Accordingly, what is claimed is:

1. An electrical contact adapted to be retained in an electrical connector housing, said contact comprising:

a contact section for engagement with a conductive surface; and a retention section for frictional engagement with a portion of said electrical connector housing, said retention section includes at least one seam extending along a portion thereof, and said seam comprises a collapsed punch out formed during a forming process of said electrical contact;

a latching projection disposed on the retention section along the at least one seam the latching projection forming a frictional engagement with the electrical connector housing, an apex of the latching projection being aligned with said seam.

2. The electrical contact of claim 1, wherein a portion of said latching projection is located on a generally radially directed shoulder formed on said retention section.

3. The electrical contact of claim 1, wherein said latching projection is located adjacent to a radiused portion of shoulder formed on said retention section.

4. The electrical contact of claim 1, wherein said latching projection comprises a portion of both a generally radially directed shoulder formed on said retention section, and an annular surface formed on said retention section.

5. The electrical contact of claim 1, wherein said latching projection comprises localized geometrical discontinuities due to said seam and said forming process.

6. The electrical contact of claim 1, wherein said latching projection comprises a localized material stress concentration due to said forming process.

7. The electrical contact of claim 1, wherein said latching projection comprises a sharp edge.

8. The electrical contact of claim 1, wherein said retention section is disposed adjacent to a pin contact section.

9. The electrical contact of claim 1, wherein a plurality of different seams are formed on said contact during said forming process.

10. The electrical contact of claim 9, wherein said seams are angularly spaced apart at generally regular angular intervals.

11. The electrical contact of claim 9, wherein a radial shoulder is formed on said retention section, said shoulder comprising a portion of at least one of said seams.

12. The electrical contact of claim 9, wherein a shank section is formed adjacent to said retention section, said shank section comprising a portion of at least one of said seams.

13. The electrical contact of claim 9, wherein a transition section is formed adjacent to said retention section, said transition section comprising a portion of at least one of said seams.

14. The electrical contact of claim 1, wherein said contact includes a shank section formed adjacent to said retention section, said shank and retention sections comprising unequal outer diameter dimensions relative to a center of said electrical contact.

15. The electrical contact of claim 14, wherein said seam extends along a shoulder formed between said retention and shank sections.

16. The electrical contact of claim 14, wherein said seam comprises a latching projection formed on said retention section.

17. An electrical connector assembly including an electrical connector housing and an electrical contact, said assembly comprising:

said electrical connector housing includes a latching arm formed therein for latching engagement with said electrical contact; and said electrical contact includes a retention section for frictional engagement with said latching arm, said retention section includes at least one seam extending along a portion thereof, and said seam comprises a collapsed punch out formed during a forming process of said electrical contact;

a latching projection disposed on the retention section along the at least one seam for frictional engagement with said latching arm, an apex of the latching projection being aligned with said seam.

18. The assembly of claim 17, wherein a plurality of different seams are formed on said retention section for engagement with said latching arm.

19. The assembly of claim 18, wherein said seams are angularly spaced apart at generally regular angular intervals comprising first angles centered generally about a longitudinal center of said retention section.

20. The assembly of claim 19, wherein said latching arm comprises a latching pawl for engagement with said retention section.

21. The assembly of claim 20, wherein said latching pawl comprises side portions which define a second angle centered generally at said longitudinal center of said retention section.

22. The assembly of claim 21, wherein said second angle is greater than one of said first angles.

23. The electrical contact of claim 17, wherein said seam is generally coincident with a latching projection formed on said contact, said latching projection being positioned to frictionally engage said latching arm.

24. The electrical contact of claim 23, wherein said latching projection comprises localized geometric discontinuities due to said seam and said forming process.

25. The electrical contact of claim 23, wherein said latching projection comprises a localized material stress concentration due to said forming process.

26. The electrical contact of claim 23, wherein said latching projection comprises a sharp edge.

27. An electrical connector assembly including an electrical connector housing and an electrical contact, said assembly comprising:

said electrical connector housing includes a latching arm formed therein for latching engagement with said electrical contact;

said electrical contact includes a retention section for frictional engagement with said latching arm, said retention section includes at least one seam extending along a portion thereof comprising a collapsed punch out, and said retention section comprises a plurality of latching projections formed on said retention section during a forming process of said electrical contact;

and said latching projections are spaced along a shoulder of said retention section so that a portion of said latching arm will engage at least one of said latching projections regardless of the rotational orientation of said contact with respect to said housing, said latching projection disposed on the retention section along the at least one seam, an apex of the latching projection being aligned with said seam, the latching projection forming a frictional engagement with the electrical connector housing.

28. An electrical contact adapted to be retained in an electrical connector housing, said contact comprising:

a contact section for engagement with a conductive surface; and a retention section for frictional engagement with a portion of said electrical connector housing, said retention section includes a plurality of seams extending along a portion thereof, said seams are angularly spaced apart at generally regular angular intervals;

a latching projection disposed on the retention section along the at least one seam, an apex of the latching projection being aligned with said seam, the latching projection forming a frictional engagement with the electrical connector housing.

29. An electrical contact adapted to be retained in an electrical connector housing, said contact comprising:

a contact section for engagement with a conductive surface;

a retention section for frictional engagement with a portion of said electrical connector housing, said retention section includes a plurality of seams extending along a portion thereof, said retention section including latching projections disposed on the retention section for frictional engagement with said electrical connector housing, each of said latching projections being disposed along one of said plurality of seams, an apex of the latching projection being aligned with said seam; and a shank section formed adjacent to said retention section, said shank section comprising a portion of at least one of said seams.

30. An electrical contact adapted to be retained in an electrical connector housing, said contact comprising:

a contact section for engagement with a conductive surface;

a retention section for frictional engagement with a portion of said electrical connector housing, said retention section includes at least one seam extending along a portion thereof, and said seam is formed during a forming process of said electrical contact; and said retention section includes at least one latching projection, said latching projection comprises a portion of both a generally radially directed shoulder formed on said retention section, and a generally annular surface formed on said retention section, the latching projection being disposed along said at least one seam, the latching projection forming a frictional engagement with the electrical connector housing.

31. An electrical contact adapted to be retained in an electrical connector housing, said contact comprising:

a contact section for engagement with a conductive surface; and a retention section for frictional engagement with a portion of said electrical connector housing, said retention section includes at least one seam extending along a portion thereof, and said seam is formed during a forming process of said electrical contact, a latching projection disposed on the retention section along the at least one seam, an apex of the latching projection being aligned with the seam for frictional engagement with said electrical connector housing; and said contact includes a shank section formed adjacent to said retention section, said shank and retention sections comprising unequal outer diameter dimensions relative to a center of said electrical contact, and said seam extends along a shoulder formed between said retention and shank sections.

* * * * *